US010526800B2

(12) United States Patent
Hernandez

(10) Patent No.: US 10,526,800 B2
(45) Date of Patent: Jan. 7, 2020

(54) JOINT COMPOUND SPREADING TOOL FOR DRYWALL JOINT FINISHING

(71) Applicant: Hernandez Family Assets LLC, Staten Island, NY (US)

(72) Inventor: Michael Hernandez, Staten Island, NY (US)

( * ) Notice: Subject to any disclaimer, the term of this patent is extended or adjusted under 35 U.S.C. 154(b) by 0 days.

(21) Appl. No.: 16/180,598

(22) Filed: Nov. 5, 2018

(65) Prior Publication Data

US 2019/0071882 A1 Mar. 7, 2019

Related U.S. Application Data

(63) Continuation-in-part of application No. 14/967,485, filed on Dec. 14, 2015, now abandoned.

(60) Provisional application No. 62/134,544, filed on Mar. 17, 2015.

(51) Int. Cl.
*E04F 21/16* (2006.01)
*E04F 21/165* (2006.01)
*E04F 21/02* (2006.01)

(52) U.S. Cl.
CPC ..... *E04F 21/1652* (2013.01); *E04F 21/026* (2013.01); *E04F 21/161* (2013.01); *E04F 21/1655* (2013.01)

(58) Field of Classification Search
None
See application file for complete search history.

(56) References Cited

U.S. PATENT DOCUMENTS 2,800,672 A * 7/1957 Gilyan ..... E04F 21/06 15/105
2,934,936 A * 5/1960 Vernon ..... E04F 21/06 15/235.4
4,620,369 A * 11/1986 Gercken ..... B25G 1/10 30/168
2002/0104182 A1* 8/2002 Panfili ..... B25G 1/00 15/236.01
2007/0017052 A1* 1/2007 Bruno ..... A47L 13/022 15/236.01
2007/0017101 A1* 1/2007 Perez ..... E04F 21/06 30/169
2007/0074401 A1* 4/2007 Myers ..... B25G 1/00 30/142
2009/0032197 A1* 2/2009 Harman, Jr. ..... B65H 75/08 156/575
2011/0041277 A1* 2/2011 Giannantonio ..... E04F 21/161 15/235.7
2016/0281374 A1* 9/2016 Hernandez ..... E04F 21/1652

* cited by examiner

*Primary Examiner* — Jeffry H Aftergut

(57) ABSTRACT

A hand tool is provided for the application of joint compound on wall board, having a planar blade affixed to an ergonomic handle. The blade has a concave arcuate working edge, wherein the concave arcuate curve extends the entire length of the working edge to each corner of the working edge. The concave arcuate working edge may be used to apply a self-feathered layer joint compound over drywall tape on planar butt joint or an inside corner joint. The blade is laterally flexible.

6 Claims, 4 Drawing Sheets

JOINT COMPOUND SPREADING TOOL FOR DRYWALL JOINT FINISHING

CROSS REFERENCE TO RELATED APPLICATIONS

This application claims priority to U.S. patent application Ser. No. 14/967,485, filed Dec. 14, 2015, currently pending, which claims priority to U.S. Patent Application No. 62/134,544, filed Mar. 17, 2015.

FIELD OF THE INVENTION

This invention pertains to a hand tool for the application of joint compound to drywall joints in building construction.

BACKGROUND

Walls in building construction are typically formed from sheets of drywall nailed or screwed to a wood or metal framework. The sheets of drywall are variously referred to as plasterboard, wallboard, gypsum board, SHEETROCK®, and other names, which are generally interchangeable here. Drywall for most walls is fabricated from a gypsum core with a paper exterior that can be painted or finished with some other surface when complete. Gypsum drywall has the advantage of being fairly easy to cut and install, and imparts a degree of fire-proofness on the final construction. Other specialized wall boards are available for example, boards made from concrete for wet environments.

The joints between sheets of drywall are conventionally finished by applying a layer of joint compound, embedding a strip of drywall tape in the wet joint compound, and applying one or more additional layers of joint compound over the tape with various knives, blades, and other tools to smooth the joint compound covering the joint and tape in order to obtain a smooth finish without a visible seam. For the purposes of this disclosure, the term "joint compound" includes products known as wall mud, plaster, or spackle intended for use in covering joints. Joint compound is supplied premixed or as a powder mixed with water.

Obtaining a perfectly smooth and finished seam between drywall joints is a difficult task, that requires significant artistry in the current state of the art. The process of smoothing the joint compound covering a wallboard joint and tape is called "feathering" or "floating" and requires substantial skill and time in order to obtain a high-quality smooth finish with an invisible seam. When a joint is feathered, one or more layers of joint compound are applied to an imperfection on the surface of the wall, such as a joint between two sheets of drywall, and the joint compound over the imperfection is manually smoothed by repeated scrapings with a tool such as a taping knife, a joint knife, and/or sanding and sponging. The objective of feathering is to smoothly taper the joint compound over the imperfection.

Joint compound is typically applied with a combination of taping knives, joint knives, and putty knives, which conventionally have a straight edge on the working edge. The term "working edge" means the edge of the tool in primary contact with the wall and/or joint compound, which is typically distal from the handle of the tool.

SUMMARY OF THE INVENTION

This invention discloses a tool that improves the feathering or floating process in applying joint compound to joints in the finishing of walls in construction. Also disclosed are methods of using the inventive tools to apply joint compound to butt joints and inside corner joints.

In an embodiment, the tool may be a drywall taping knife with a slightly flexible planar blade non-detachably and non-slidably affixed to a handle, the blade having a concave arcuate working edge distal to the handle, wherein the working edge has a corner on each end of the working edge and the concave arcuate curve extends the entire length of the working edge to each corner, and wherein the blade has two side edges on each side of the working edge. The handle has an approximately cylindrical body with grip diameter of between 1" to 2" inches, which allows fingers to wrap comfortably around the handle, which reduces stress and impact on hands, fingers and wrists and prevents slippage.

In an embodiment, a method is provided for applying joint compound to a butt joint between two wall boards that form a planar surface, by applying a layer of joint compound to the butt joint, a layer of tape, and a second layer of joint compound, wherein the tool as disclosed herein with a concave arcuate working edge is pulled along the joint so the corners of the working edge of the tool are in contact with the planar surface and aligned approximately perpendicularly to the direction of the pulling. The pulling of the tool may be angled at an angle defined by the surface of the wall, the corners of the working edge of the tool, and the plane of the blade, to spread and self-feather the second layer of joint compound over the tape. After applying the joint compound, the surface can be slightly convex. The blade is slightly bendable, which allows for adjustment of the concave arching of the blade with respect to the wall, when force is applied on the handle while pulling the tool.

In an embodiment, a method is provided for applying joint compound to an inside corner joint between two wall board surfaces, wherein the surfaces are in an approximately perpendicular orientation between the two surfaces, by applying a layer of joint compound to each corner surface of the corner joint, a layer of tape to each corner surface, and a second layer of joint compound over the tape, and pulling the tool as disclosed herein with a concave arcuate working edge along the axis of the edge. The pulling of the tool may be crabbed slightly by keeping the distal corner of the working edge slightly behind the proximal corner of the working edge such that the proximal edge of the blade is not in direct contact with the other approximately perpendicular surface of the inside corner. The pulling of the tool may form an angle defined by a surface of the wall, the corners of the working edge of the tool, and the plane of the blade, to spread and self-feather the layer of joint compound over the corner bead.

DETAILED DESCRIPTION

This disclosure provides tools and methods that may be useful for the application of joint compound to butt joints and inside joints of drywall construction. The inventive tool may be provided in the format of a tape knife, or similar tool, and has a concave arcuate curved working edge in which the arcuate curve extends the entire length of the working edge. As this tool is dragged along a seam in dry wall construction to spread joint compound, the concave arcuate curve smooths the joint compound, self-feathering the joint compound over the drywall tape. The self-feathered joint is normally clean enough and smooth enough that it has a finished appearance, without the application of an additional finish coat. The self-feathered joint can be directly painted over to give a smooth wall.

Figure 1:
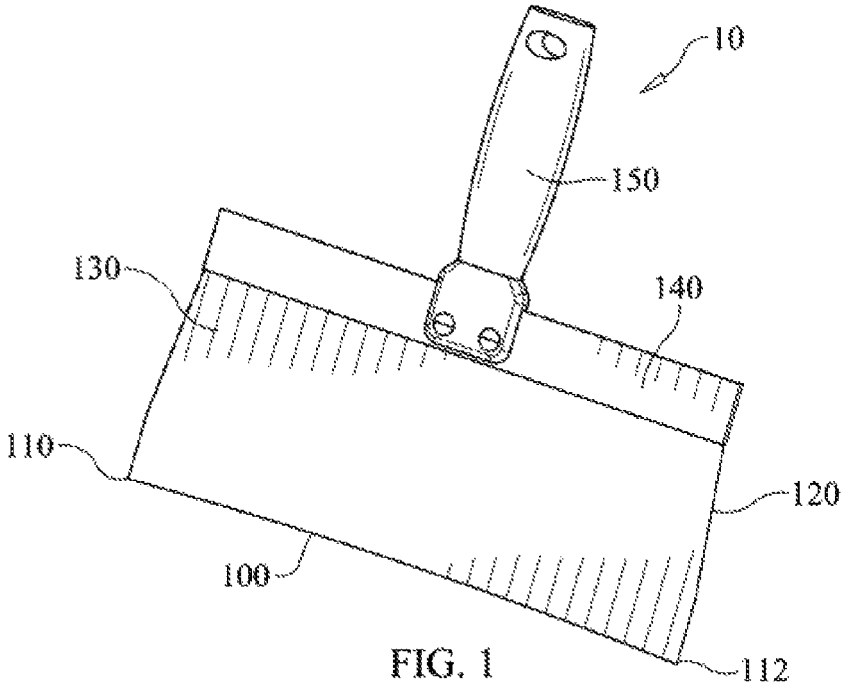
FIG. 1 is a perspective view of a drywall taping knife embodiment of this invention.
Figure 5:
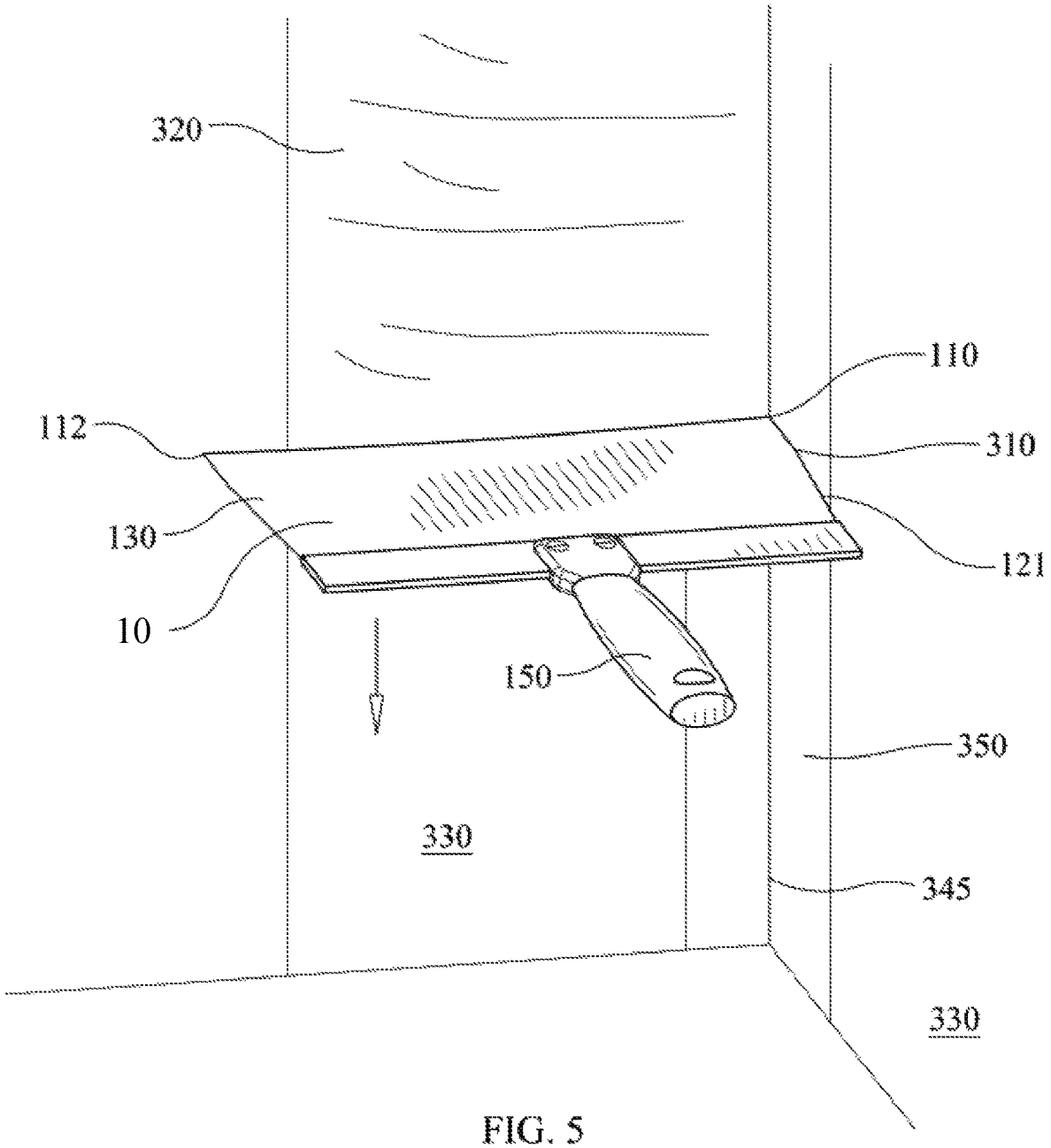
FIG. 5 is a perspective view of a method of applying joint compound to an inside corner joint.
Figure 6:
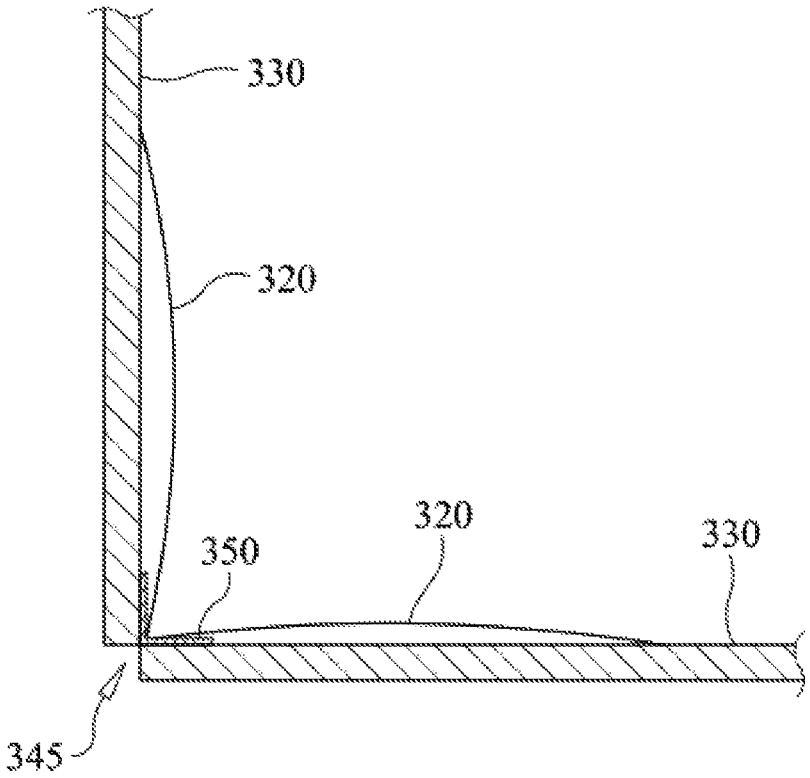
FIG. 6 is a cross section view of a finished inside corner joint.

Previous disclosures have provided distinctly different approaches to the problem of feathering joint compound or plaster over drywall seams. For example, U.S. Pat. No. 2,800,672, discloses a complex device for applying plaster to drywall with two blades in which a blade with a curved edge is slidable between a working and non-working position to apply a curved layer of plaster, but not a layer that is self-feathered. In the '672 patent, a finish coat must be applied (FIG. 5-6, 1: 39-41).

Figure 2:
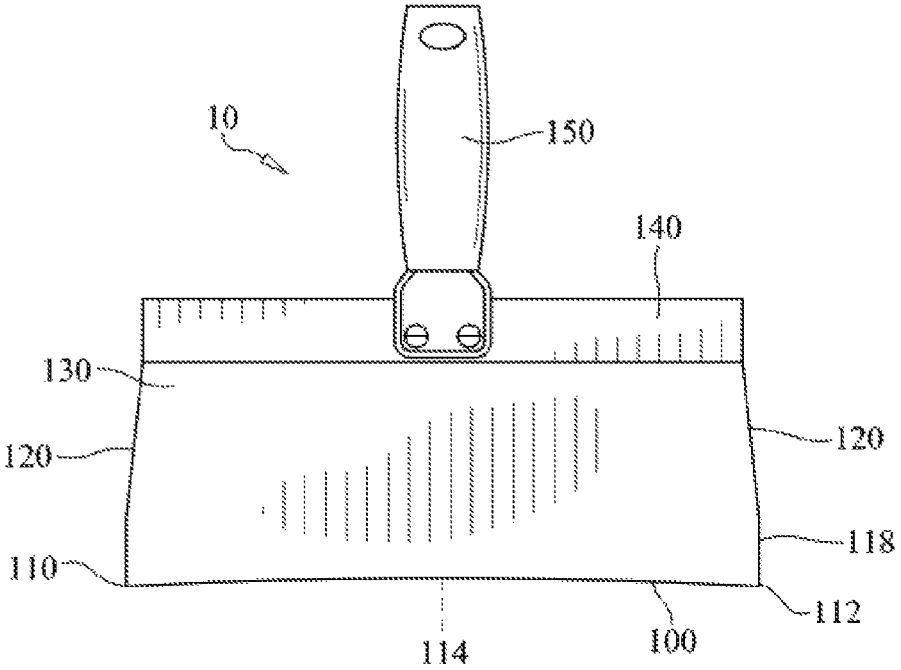
FIG. 2 is a front view of a drywall taping knife embodiment of this invention.

US patent publication 2002/0002754 discloses drywall tools with a concave portion on the working edge, but having flat portions (see FIGS. 2, 16a and 16b).

US patent publication 2008/0295435 discloses drywall tools with various curved edges. FIG. 3A in the '435 publication appears to disclose a working edge with a concave portion (item 340 and 340'), but requiring non-concave portions on the ends (item 335 and 335'). In addition, tool in the '435 publication has an arched blade, not a planar blade as in the invention disclosed herein ('435 FIG. 3b).

U.S. Pat. No. 7,647,668 provides taping knives and joint knives with a notched portion on the working edge to aid in making flat and even drywall joints.

The difficulty in finishing drywall comes from the feathering of the joint compound and then sanding the joint compound to obtain a finished surface without perceivable edges. This requires time and skill. When feathering a joint the extra mud is usually removed by multiple strokes, with at least one stroke on one side of the seam by passing the edge of the tapping knife distal to the seam tight to the wall and the edge closer to the seam away from the wall, another similar strike on the other side of the seam and an additional strike going over the seam and the whole joint. Removing the extra mud, however often requires repeating the steps several times. After the joint compound is feathered it typically has to be further smoothened by using a wet sponge or cloth and/or by sanding. The tool of the subject invention is designed to spread and self-feather a second layer of joint compound to provide a smooth continuous wall surface with one or two strokes. One object of the invention is to provide for a tool with minimum number of components which is easy to use and clean and economical to manufacture.

Another object of the present invention is to provide for a tool which is suitable for extended use, comfortable to manipulate and requiring minimal force to operate.

A further object of the present invention is to provide for a tool which provides additional control over the degree of smoothing of the convex surface of the wall depending on its specific characteristics.

As disclosed herein, a hand tool is provided for the application of joint compound on wall board, with a planar slightly flexible blade fixed to an ergonomic handle, the blade having a concave arcuate working edge distal to the handle, wherein the working edge has a corner on each end of the working edge and the concave arcuate curve extends the entire length of the working edge to each corner, and wherein the blade has two side edges on each side of the working edge. There is only a single blade in this tool, in contrast to prior art tools with dual blades.

The ergonomic handle is designed to be comfortable and effective while used, which is essential for wall finishing which may require the use of the tool over several hours. The term ergonomic refers to tools specifically designed to be easy and comfortable. The word is derived from Greek—"ergon", meaning work, and "nomoi"—natural laws.

Moreover, the taping knife of the present invention is essentially rigid in the direction perpendicular to the handle, which is its longitudinal direction (X), yet when pressure is applied it is slightly flexible in the direction parallel to the handle, its lateral direction (Y).

FIGS. 1 and 2 illustrate a taping knife embodiment (10) of this invention. In this embodiment, a planar blade 130 has a concave arcuate working edge 100, wherein the arcuate curve extends completely to corner edges 110 and 112. The blade has side edges 120. The blade is mounted in blade mount 140. Handle 150 is non detachably and non slidably affixed to the blade mount 140. In the taping knife embodiment, the planar blade 130 of the tool is approximately trapezoidal wherein the working edge 100 and edge bearing the handle are parallel and form the longer dimension of the trapezoid, while the side edges 120 are not parallel, except for the portions close to the working edge which are parallel 118.

The working edge 100 in FIGS. 1 and 2 is defined by corners 110 and 112, and by center point 114. Center point 114 is equidistant between corners 110 and 112. The working edge 100 is not a straight line, but rather defines a concave shape, with an inwardly curved profile, as depicted by the elevation view in FIG. 2. The inward arch of the curve of working edge 100 is curved towards the handle 150. Thus, because of the concave arcuate curve of working edge 100, if tool 10 was placed in an approximately perpendicular orientation to a planar flat level surface, such that corners 110 and 112 were in contact the surface, center point 114 would be elevated above the surface by several millimeters. Center point 114 would not be in contact with the planar surface. However, as the blade is slightly flexible, if force is applied on the handle in the direction of the wall while the tool is pulled in a direction parallel to the wall, the angle of the blade with respect to the wall surface and subsequently the thickness of the layer of joint compound may be adjusted. This characteristic is important when applying the joint compound to walls that have irregular or bumpy sections.

In the taping knife embodiment, the planar blade 130 of the tool is approximately trapezoidal, wherein the working edge and edge bearing the handle are parallel and form the longer dimension of the trapezoid, while the side edges are not parallel, except for the portions proximate to the working edge which are parallel. In a trapezoidal embodiment, the longer parallel side is the arcuate working edge 100. Drywall taping knives are typically supplied in 6 in. (15 cm), 8 in. (20 cm), 10 in. (25 cm), 12 in. (30 cm), and 14 in. (36 cm) widths. In an embodiment, the drywall taping knife of the present invention has blade width of 6 in. (15 cm), 8 in. (20 cm), 10 in. (25 cm), 12 in. (30 cm), and 14 in. (36 cm) widths, which allows the curvature of mud in the cross section to be essentially invisible, and the seam can be painted over directly.

The blades are typically made of steel that is about 0.15 mm to about 1.0 mm thick. Other materials may be used for the blade, for example, aluminum or plastic, if they are sufficiently stiff to provide rigidness in the longitudinal direction of the blade and some flexibility in its lateral direction, when pressure is applied.

In an embodiment, a tool according to this invention may be used to self-feather the application of joint compound to a taped butt joint between two sheets of drywall. In an embodiment, a butt joint may be finished using the inventive tool by applying a layer of joint compound to the joint (not shown) and embedding joint tape 301 in the layer of joint compound so that the tape covers the seam 340 between the two sheets. A conventional joint or tape knife may be used in this step. The joint compound in this step is smoothed with the knife and may be allowed to dry.

In a second step of this embodiment, a larger quantity of joint compound is applied over the covered with joint compound tape 300 using an inventive tape knife 10. A fairly thick layer of joint compound may be smeared over a length of the taped joint. A tape knife 10 according the instant invention, with a concave arcuate curvature along the working edge of the blade, is run along the joint.

Figure 3:
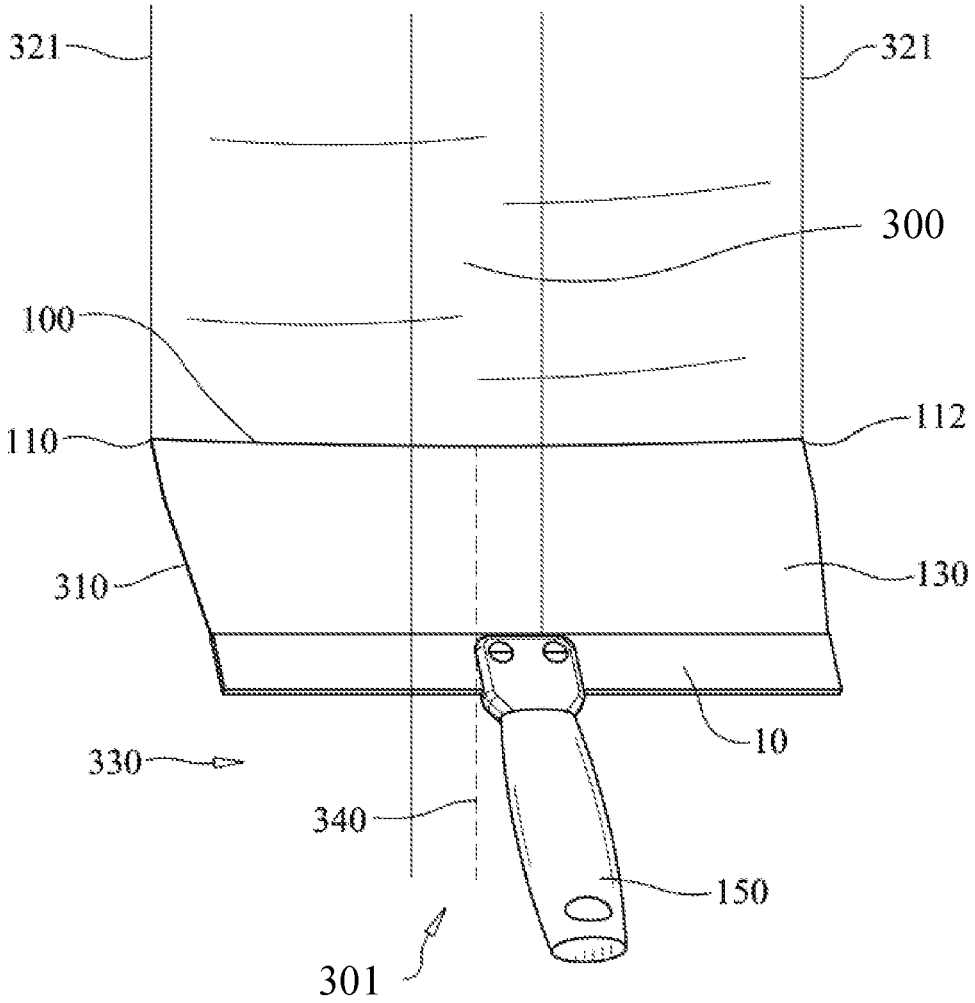
FIG. 3 is a perspective view of a method of applying joint compound to a butt joint.
Figure 4:
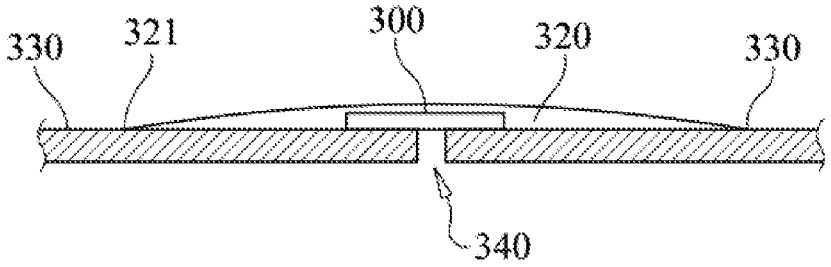
FIG. 4 is a cross section view of a finished butt joint with essentially invisible curvature of the mud.

With a butt joint along a vertical or horizontal seam 340 (FIGS. 3 and 4) (the gap between the two sheets of drywall 330 is exaggerated in FIG. 4 for clarity; more typically, the two sheets of drywall will be in contact with each other along the seam 340 of the joint), the direction of the pulling of the tape knife 10 will be along the seam with the blade corners 110 and 112 aligned in a perpendicular orientation to the seam, as shown in FIG. 3. By applying slight force and adjusting the angle of the blade with respect to the wall surface, the thickness of the layer of joint compound 320 may be adjusted. The angle of the blade for this purpose is defined by the plane of blade 130 and the wall surface 330, with the vertex the being an imaginary straight line between edges 110 and 112 of the working edge of the blade. The ends of the layer of joint compound 321 will be defined by the edges of the blade 110 and 112.

By using this technique with tool 10, a clean self-feathered layer 320 of joint compound with clean edges 321, and requiring minimal sanding or sponging as compared with conventional feathering techniques, may be obtained. The joint tape 301 (FIG. 3) is smoothly covered by the joint compound. The joint tape covered by a layer of joint compound by the inventive tool is depicted as 300 in FIGS. 3 and 4. Optionally, a third layer of joint compound may be applied, often called a finish coat, with a wider knife 10 than is used in the second coat of joint compound.

In the conventional application of joint compound, the user must manually adjust pressure on the knife to feather the joint and obtain a smooth finish. This typically requires sponging of the surface, while still wet, and sanding once dry, to obtain a perfectly smooth finish. By using the tool of the instant invention, the application of a smooth coat of joint compound with the tools is much more efficient, resulting in less of a need for sponging or sanding when complete.

In another embodiment, the tools as disclosed herein can be used to evenly spread joint compound on inside corner joints. In an embodiment, two edges of drywall forming an inside corner 345 (FIGS. 5 and 6) are provided. For clarity in this explanation, the two surfaces can be described as being on an X and Y axis, and forming an X and Y surface according to basic geometry conventions, when viewed in cross section as shown in FIG. 6.

A layer of joint compound may be applied to the edge of each X and Y surface, and corner drywall tape 350 is applied to the corner. Many types of drywall tape are provided with a crease along the centerline, allowing the tape to be folded 90° along the center line, so that a single strip of tape fits evenly along both X and Y surfaces in the corner. Using a taping knife, the corner drywall tape 350 is embedded in the layer of joint compound with one half the tape (along the long axis) in contact with the X surface, and one half the tape in contact with the Y surface, with the centerline of the tape nested in edge 345.

In a second step of this embodiment, shown in FIG. 5, a second quantity of joint compound is placed along one side of the joint. For convenience only, this will be referred as the X surface. A taping knife 10 according to the instant invention, is then run along the X surface with inside corner 110 of tool blade 130 in intimate contact with the inside of edge 345. A quantity of excess joint compound 310 is pulled under tool blade 130.

As tool 10 is pulled along the seam of corner 345, a smooth, self-feathered layer 320 of joint compound will be established along the X surface, covering tape 350 with a smooth layer of joint compound.

In an embodiment, tool 10 may be crabbed slightly while it is pulled along the X surface in the corner, so that outside corner 112 of blade 130 is slightly behind inside corner 110. In this configuration, the inside (or proximal) blade edge 121 is not in contact with the Y surface. Tool 10 may be pulled at an angle relative to the X surface 330, defined by handle 150 corner 112, and surface 330 can be adjusted to adjust the thickness of joint compound layer 320.

In this embodiment, a similar technique is employed to apply a self-feathered layer of 320 of joint compound on the Y surface. Thus, after a self-feathered layer of joint compound is applied to the X surface, a quantity of joint compound is then applied to the Y surface of the joint, and tool 10 or 20 is pulled along the Y surface with inside corner 112 in contact with the corner. The tool is crabbed slightly to the inside edge 121 is not in contact with the X surface. This procedure will apply a smooth layer of joint compound 320 to the Y surface.

The result is shown in cross section in FIG. 6, depicting two sheets of drywall 330 joined with an inside corner joint, and smooth feathered layers of drywall mud 320 spread over the corner tape 350.

The invention claimed is:

1. A method for applying joint compound to a butt joint between two drywall boards that form a planar surface, Comprising:

a) applying in sequence a layer of joint compound to the butt joint, a layer of tape, and a second layer of joint compound, b) pulling a hand tool along the joint, the hand tool having a handle and a slightly flexible planar blade non detachably and non slidably affixed to the handle, the blade having a concave arcuate working edge distal to the handle, wherein the working edge has a corner on each end of the working edge and the concave arcuate curve extends the entire length of the working edge to each corner and wherein the blade has two side edges on each side of the working edge, when the hand tool is pulled along the joint the corners of the working edge of the tool are in contact with the planar surface and aligned approximately perpendicularly to the direction of the pulling, c) wherein the pulling of the tool forms an angle defined by the surface of the wall, the corners of the working edge of the tool and the plane of the blade, to spread and self-feather the second layer of joint compound over the tape thereby forming a self-feathered joint with one stroke leaving a smooth continuous wall surface, d) wherein the self-feathered joint can be directly painted over without application of a finish coat to give a smooth wall.

2. The method of claim 1 wherein the planar blade of the tool is approximately rectangular wherein the working edge and edge bearing the handle form the longer dimension of the rectangle.

3. The method of claim 1 wherein the planar blade of the tool is elongated and forms an approximate trapezoid, wherein the long edge is the concave arcuate working edge and the handle is affixed to the blade distal from the working edge.

4. A method for applying joint compound to an inside corner joint between two drywall board surfaces, wherein the surfaces are in an approximately perpendicular orientation between the two surfaces, comprising a) applying a layer of joint compound to each corner surface of the corner joint, a layer of tape to each surface aligned with the corner, and a second layer of joint compound over the tape, b) pulling a hand tool along the axis of the edge, the hand tool having a handle and a slightly flexible planar blade non detachably and non slidably affixed to the handle, the blade having a concave arcuate working edge distal to the handle, wherein the working edge has a corner on each end of the working edge and the concave arcuate curve extends the entire length of the working edge to each corner and wherein the blade has two side edges on each side of the working edge, when the hand tool is pulled along the axis a proximal corner of the working edge of the tool abuts the approximately perpendicular wall board surface and the distal corner of the working edge is in contact with the wall surface, c) wherein the pulling of the tool is crabbed slightly by keeping the distal corner of the working edge slightly behind the proximal corner of the working edge such that the proximal edge of the blade is not in direct contact with the other approximately perpendicular surface of the inside corner;

d) wherein the pulling of the tool forms an angle defined by a surface of the wall, the corners of the working edge of the tool, and the plane of the blade, to spread and self-feather the layer of joint compound over the corner bead thereby forming a self-feathered joint with one stroke leaving a smooth continuous wall surface;

e) wherein the self-feathered joint can be directly pained over without application of a finish coat to give a smooth wall, and f) wherein steps b-d are repeated for the other side of the corner.

5. The method of claim 4 wherein the planar blade of the tool is approximately rectangular wherein the working edge and edge bearing the handle form the longer dimension of the rectangle.

6. The method of claim 4 wherein the planar blade of the tool is elongated and forms an approximate trapezoid, wherein the long edge is the concave arcuate working edge and the handle is affixed to the blade distal from the working edge.

* * * * *